US007461839B2

(12) United States Patent
Ikeda

(10) Patent No.: US 7,461,839 B2
(45) Date of Patent: Dec. 9, 2008

(54) SHEET FEEDING APPARATUS AND IMAGE FORMING APPARATUS

(75) Inventor: Taro Ikeda, Taito-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 5 days.

(21) Appl. No.: 11/624,624

(22) Filed: Jan. 18, 2007

(65) Prior Publication Data

US 2007/0170638 A1 Jul. 26, 2007

(30) Foreign Application Priority Data

Jan. 20, 2006 (JP) ..... 2006-013075

(51) Int. Cl.
*B65H 3/08* (2006.01)

(52) U.S. Cl. ..... 271/108; 271/96

(58) Field of Classification Search ..... 271/97, 271/98, 108, 96

See application file for complete search history.

(56) References Cited

U.S. PATENT DOCUMENTS 4,291,974 A * 9/1981 Silverberg ..... 355/76
5,645,274 A * 7/1997 Ubayashi et al. ..... 271/94
5,893,554 A * 4/1999 Okahashi et al. ..... 271/98
6,254,081 B1 * 7/2001 Rasmussen et al. ..... 271/96

FOREIGN PATENT DOCUMENTS

JP 06-001467 1/1994

* cited by examiner

*Primary Examiner*—Kaitlin S Joerger
(74) *Attorney, Agent, or Firm*—Canon USA Inc I P Div

(57) ABSTRACT

A sheet feeding apparatus for blowing air against sheets in feeding the sheets. The apparatus includes a suction duct disposed over a sheet stacking unit and having a suction opening facing the sheet stacking unit, a negative pressure generating unit for generating negative pressure in the suction duct, a sheet conveyance unit suctioning the sheet thereto with the negative pressure so as to convey the sheet, a communicating opening adapted to communicate with an exterior and provided in the suction duct. The communicating opening is closed by a cover according to a magnitude of a negative pressure in the suction duct. When a detection unit detects that the communicating opening has been closed with the cover, a control unit drives the sheet conveyance unit.

4 Claims, 9 Drawing Sheets

SHEET FEEDING APPARATUS AND IMAGE FORMING APPARATUS

BACKGROUND OF THE INVENTION

1. Field of the Invention

The present invention relates to a sheet feeding apparatus, and to an image forming apparatus having the sheet feeding apparatus. More particularly, the present invention relates to a structure adapted to blow air against an end surface of a sheet stack to separate and supply sheets of the sheet stack one by one.

2. Description of the Related Art

A conventional image forming apparatus, such as a copying machine or a printer, has a sheet feeding apparatus adapted to separate sheets stacked on a sheet stacking unit from an uppermost sheet one by one and to feed the separated sheets to an image forming unit one by one.

As discussed in, for example, U.S. Pat. No. 5,645,274, a sheet feeding apparatus blows gas (mainly air) against a sheet stack on a sheet stacking unit to float and separate a plurality of sheets. Then, the sheet feeding apparatus suctions an uppermost one of the sheets to a conveyance belt to feed the suctioned sheet.

FIG. 5 illustrates such a sheet feeding apparatus adapted to separate a sheet by using air and to feed the separated sheet by suctioning the separated sheet to the conveyance belt.

A repository 11 shown in FIG. 5 stores a plurality of sheets S and is provided in an image forming apparatus body (not shown) to be drawable therefrom. A sheet tray 12, on which the sheets S are mounted, is provided in the repository 11 to be movable up and down. Also, a rear end regulating plate 13 and side end regulating plates 14 are provided in the repository 11. The rear end regulating plate 13 regulates a rear end position of a sheet stack SA, which is an upstream end position in a sheet feeding direction. The side end regulating plates 14 regulate side end positions of the sheet stack SA, which are end positions in a width direction perpendicular to the sheet feeding direction. Additionally, slide rails 15 used to draw the repository 11 from the image forming apparatus body (not shown) are provided in the repository 11. The rear end regulating plate 13 and each of the side end regulating plates 14 are movable in the sheet feeding direction and in the width direction perpendicular to the sheet feeding direction, respectively, according to the size of sheets mounted on the sheet tray 12.

A suction conveyance belt 21 conveys a sheet by suctioning the sheet thereto. A suction fan 36 is adapted to suction a sheet to the suction conveyance belt 21. An air blowing unit 30 blows air to a front end surface of the sheet stack SA at a downstream side in the sheet feeding direction. The air blowing unit 30 includes a separation fan 31, a separation duct 32, a blowing nozzle 33, and a separation nozzle 34.

When a user puts the repository 11 into the image forming apparatus body (not shown) after the user draws the repository 11 out of the image forming apparatus body and sets the sheets S in the repository 11 in the sheet feeding apparatus, the sheet tray 12 is lifted by a drive unit (not shown) in the direction of an arrow A, as shown in FIG. 6. Then, the sheet tray 12 stops at a position at which a distance B from the top surface of the sheet stack SA to the suction conveyance belt 21 has a predetermined value. Subsequently, the sheet feeding apparatus waits for a feed signal.

Next, when a feed signal is input to the sheet feeding apparatus, the separation fan 31 operates to suction air in the direction of an arrow C shown in FIG. 7. This air is blown in the directions of arrows D and E from the blowing nozzle 33 and the separation nozzle 34, respectively, through the separation duct 32 to the front end surface of the sheet stack SA. Consequently, several sheets Sa of the sheet stack SA are floated. On the other hand, the suction fan 36 operates to blow air in the direction of an arrow F shown in FIG. 7. At that time, a suction shutter 37 provided in the suction duct 60 having a suction opening is closed.

Subsequently, after the lapse of a predetermined time since the feed signal is input to the sheet feeding apparatus, when a floating state of the several sheets Sa is stabilized, the suction shutter 37 is rotated in the direction of an arrow G, as shown in FIG. 8. Consequently, a suctioning force acting in the direction of an arrow H from suction holes (not shown) formed in the suction conveyance belt 21 is generated by the suction fan 36. The uppermost sheet Sb of the floated sheets Sa is suctioned to the suction conveyance belt 21.

Finally, the sheet Sb is fed in the direction of an arrow K together with the suction conveyance belt 21 by a belt drive roller 41 rotating in the direction of an arrow J shown in FIG. 9. Thereafter, the sheet Sb is transported to the subsequent conveyance path by a drawing roller pair 42, the rollers of which rotate in the directions of arrows L and M, respectively.

Meanwhile, in a case where such a conventional sheet feeding apparatus starts feeding the sheet Sb before the sheet Sb is completely suctioned to the suction conveyance belt 21, the following problems may occur. That is, conveyance failures, such as a jam at which a sheet is jammed while being fed, a skew at which a sheet is conveyed in a slanting direction, and a positional deviation at which the position of a sheet is deviated from a conveyance reference, may be caused. Also, damages, such as flaws, folds, and stains, may be caused to sheets.

Hitherto, a sheet feeding apparatus has been devised, which includes a pressure sensor adapted to monitor an internal pressure of a suction duct to detect completion of the suction of the sheet, as discussed in Japanese Patent No. 2750486.

Although the conventional sheet feeding apparatus employing such a pressure sensor and an image forming apparatus employing this conventional sheet feeding apparatus can detect the completion of suction of a sheet using the pressure sensor, the cost of the conventional sheet feeding apparatus and the image forming apparatus is increased due to costliness of the pressure sensor. Also, the pressure sensor is susceptible to variation in environmental conditions, such as temperature and humidity. Therefore, the conventional sheet feeding apparatus and the image forming apparatus employing the conventional sheet feeding apparatus have drawbacks in that when the environmental conditions drastically change, the completion of suction of a sheet cannot accurately be detected, and that a sheet cannot surely be separated and conveyed.

Also, in a case where the conventional pressure sensor is used, an actual measurement value is needed as a criterion for determining that the suction of a sheet to the suction conveyance belt is completed. For example, when an absolute value of an internal negative pressure of the suction duct becomes equal to or higher than 300 Pa, it is determined that the suction of a sheet to the suction conveyance belt is completed. Thus, an operation for controlling the apparatus is complicated. For example, accurate calibration of the pressure sensor is required for correcting variation in a characteristic thereof.

SUMMARY OF THE INVENTION

The present invention is directed to a sheet feeding apparatus with a simple configuration capable of surely separating and feeding sheets at low cost without being affected by the environment. The present invention is also directed to an image forming apparatus employing such a sheet feeding apparatus.

According to an aspect of the present invention, a sheet feeding apparatus is configured to blow air against an end surface of sheets stacked on a sheet stacking unit so as to float the sheet and to suction and feed the floated sheet. The sheet feeding apparatus includes a suction duct disposed above the sheet stacking unit and having a suction opening facing the sheet stacking unit, a negative pressure generating unit configured to generate a negative pressure in the suction duct, a sheet conveyance unit configured to suction a sheet thereto by utilizing the negative pressure generated by the negative pressure generating unit and to convey the suctioned sheet, a communicating opening provided in the suction duct and adapted to communicate with an exterior, a cover configured to open and close the communicating opening according to a magnitude of the negative pressure in the suction duct, a detecting unit configured to detect that the cover has closed the communicating opening, and a control unit configured to drive the sheet conveyance unit based on the detecting unit detecting that the cover has closed the communicating opening according to the negative pressure in the suction duct.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the present invention will be described in detail below with reference to the drawings.

Figure 1:
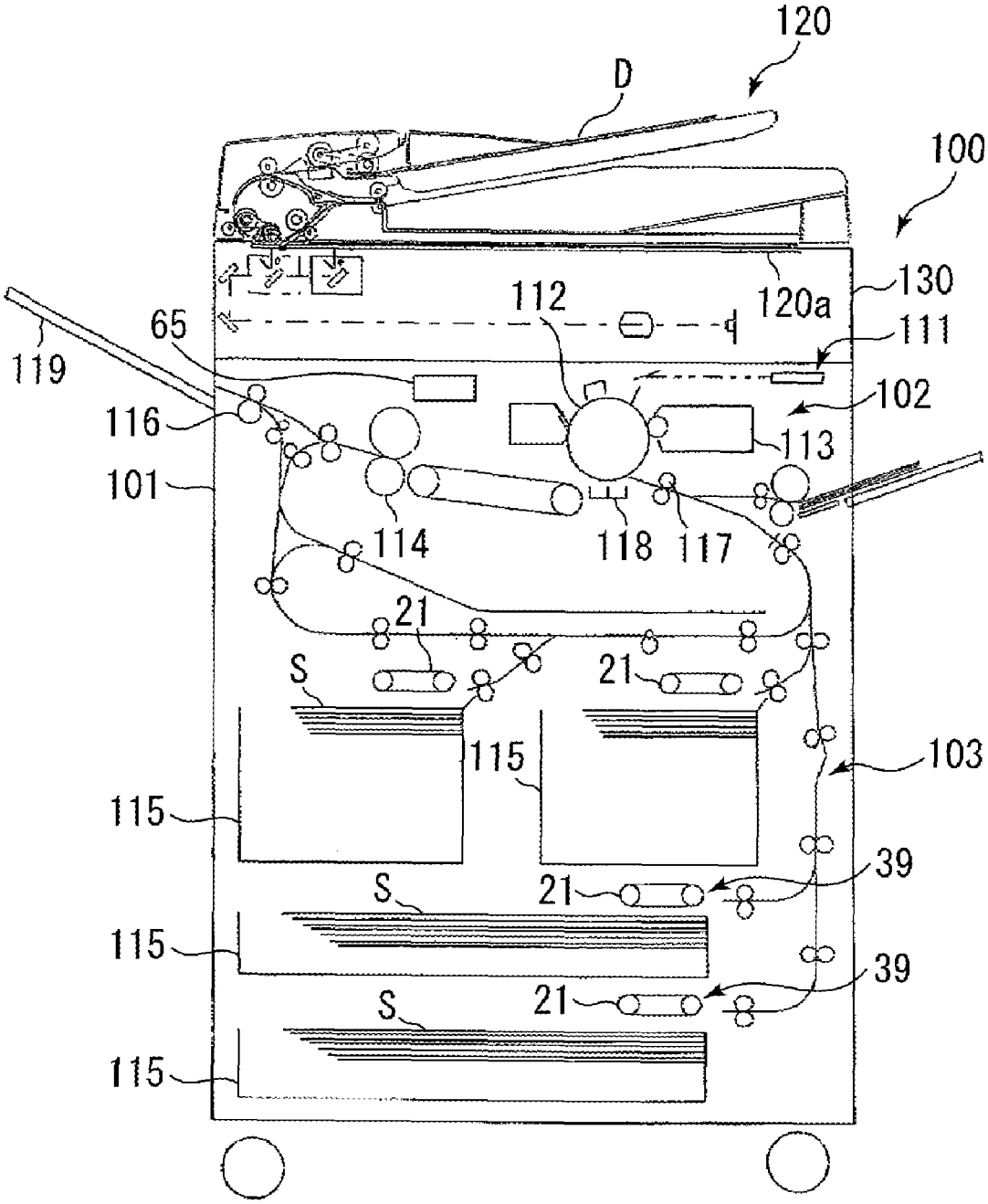
FIG. 1 is a diagram schematically illustrating a printer which is an example of an image forming apparatus having a sheet feeding apparatus according to an exemplary embodiment of the present invention.

FIG. 1 schematically illustrates a printer which is an example of an image forming apparatus having a sheet feeding apparatus according to an exemplary embodiment of the present invention.

As shown in FIG. 1, a printer 100 has a printer body 101. An image reading unit 130 is provided on the printer body 101 and is configured to read an original document D put on a platen glass 120*a*, serving as an original-document mounting table, by an automatic original-document feeding unit 120. An image forming unit 102 and a sheet feeding apparatus 103, configured to feed a sheet S to the image forming unit 102, are provided below the image reading unit 130.

A photosensitive drum 112, a developing device 113, and a laser scanner unit 111 are provided in the image forming unit 102. The sheet feeding apparatus 103 includes a plurality of sheet accommodating units 115, each of which can accommodate the sheets S (such as an overhead transparency (OHT) film) and can be detachably attached to the printer body 101. The sheet feeding apparatus 103 also includes a suction conveyance belt 21, which is an example of a sheet conveyance unit adapted to feed the sheets S accommodated in the sheet accommodating units 115.

Next, an image forming operation of the printer 100 is described below.

When an image reading signal is output from a control unit 65 provided in the printer body 101 to the image reading unit 130, the image reading unit 130 reads an image to generate an electrical signal. Subsequently, laser light corresponding to the electrical signal is irradiated onto the photosensitive drum 112 from the laser scanner unit 111.

At that time, the photosensitive drum 112 is preliminarily electrically charged. An electrostatic latent image is formed thereon by irradiating light thereonto. Subsequently, the electrostatic latent image is developed by the developing device 113. Consequently, a toner image is formed on the photosensitive drum 112.

Meanwhile, when a sheet feed signal is output to the sheet feeding apparatus 103 from the control unit 65, the sheet S is supplied from the sheet accommodating unit 115. Subsequently, the sheet S fed from the accommodating unit 115 is sent by a registration roller 117 in synchronization with the toner image formed on the photosensitive drum 112 to a transfer unit including the photosensitive drum 112 and a transfer charging device 118.

Next, the toner image is transferred onto the sheet S sent to the transfer unit. Subsequently, the sheet S is conveyed to a fixing unit 114. The sheet S is heated and pressed by the fixing unit 114. Thus, the transferred image is permanently fixed to the sheet S. Then, the sheet S, to which the image has been fixed, is discharged by a discharge roller 116 from the printer body 101 to a discharge tray 119.

Figure 2:
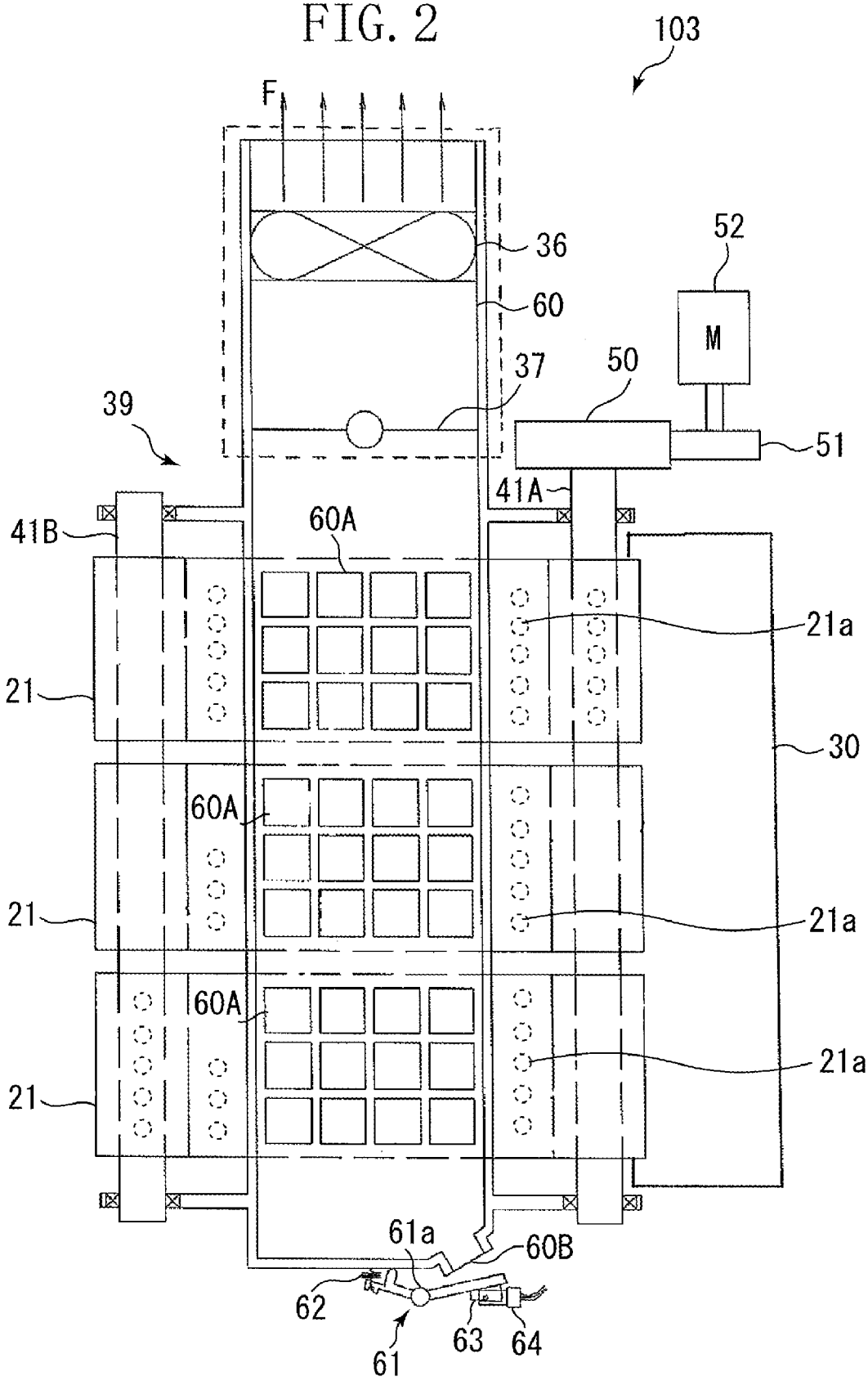
FIG. 2 schematically illustrates the sheet feeding apparatus.

FIG. 2 is a partially cross-sectional development view illustrating a duct portion of the sheet feeding apparatus 103. In FIG. 2, components similar or corresponding to those shown in FIGS. 5 to 9 are designated by the same reference numerals. A detailed description of such components is omitted herein.

As shown in FIG. 2, the sheet feeding apparatus 103 includes a sheet feeding unit 39 adapted to suction and feed sheets of a sheet stack SA placed on a sheet tray, and also includes an air blowing unit 30 adapted to blow air in a direction opposite to a sheet feeding direction against an upstream side end surface in the sheet feeding direction of the sheet stack SA.

The sheet feeding unit 39 includes a suction duct 60 and a suction fan 36. The suction fan 36 is provided in the suction duct 60 and serves as a negative pressure generating unit adapted to generate a negative pressure in the suction duct 60. The sheet feeding unit 39 also includes suction conveyance belts 21, each of which serves as an example of a sheet conveyance unit adapted to suction a sheet by utilizing a negative pressure generated by the suction fan 36. A plurality of suction holes 21*a* are formed in each of the suction conveyance belts 21. A sheet is suctioned to the suction conveyance belts 21 through the suction holes 21*a* by utilizing a negative pressure.

The sheet feeding unit 39 has parts indicated by dashed lines in FIG. 2. These parts are placed above the suction conveyance belts 21, as shown in, for example, FIG. 5. For description convenience, FIG. 2 shows a development view of the sheet feeding unit 39.

As shown in FIG. 2, belt drive rollers 41A and 41B are configured to drive the suction conveyance belts 21. Drive gears 50 and 51 are provided at an end part of the belt drive roller 41A and are driven by a drive motor 52. The belt drive roller 41A is driven to rotate by a driving force from the drive motor 52, which is transmitted through the drive gears 50 and 51. The suction conveyance belts 21 are rotated by the rotation of the belt drive roller 41A.

The suction duct 60 includes a plurality of suction openings 60A located in a predetermined area facing each of the suction conveyance belts 21. Each of the suction conveyance belts 21 rotates with an inner circumferential surface thereof abutting on the suction openings 60A. A suction detecting hole 60B is provided in an end part of the suction duct 60. The suction detecting hole 60B serves as a communicating opening adapted to cause the inside of the suction duct 60 to communicate with an exterior.

A suction detecting cover 61 is disposed swingably around a swinging shaft 61*a* in the vicinity of the suction detecting hole 60B. The suction detecting cover 61 is configured to open and close the suction detecting hole 60B. A return spring 62 serving as an elastic member is disposed at an end part of the suction detecting cover 61. A detection flag 63 is provided at the other end part of the suction detecting cover 61. The return spring 62 biases the suction detecting cover 61 by an elastic force in a direction to open the suction detecting cover 61.

When the negative pressure in the suction duct 60 becomes larger than a predetermined negative pressure, the suction detecting cover 61 is suctioned through the suction detecting hole 60B to close the suction detecting hole 60B against an elastic force of the return spring 62. The predetermined negative pressure is defined to be a negative pressure in the suction duct 60 generated when a sheet is surely suctioned to the suction conveyance belts 21. The predetermined negative pressure in the suction duct 60 is set such that a magnitude of a force of suctioning the suction detecting cover 61 is larger than that of an elastic force of the return spring 62.

When the suction detecting cover 61 is in a position to open the suction detecting hole 60B, as illustrated in FIG. 2, the detection flag 63 blocks detection light output from a photo-interrupter 64. Consequently, an output signal from the photo-interrupter 64 is at an ON-level. The detection flag 63 and the photo-interrupter 64 constitute a detection unit adapted to detect that the suction detecting cover 61 has closed the suction detecting hole 60B.

Conversely, when the suction detecting cover 61 is in a position to close the suction detecting hole 60B, detection light output from the photo-interrupter 64 is not blocked by the detection flag 63. Consequently, an output signal from the photo-interrupter 64 is at an OFF-level.

A signal output from the photo-interrupter 64 is input to the control unit 65. The control unit 65 is configured to control driving of the suction fan 36 and the drive motor 52. When a signal having an OFF-level is input from the photo-interrupter 64 to the control unit 65, the control unit 65 detects that the suction detecting hole 60B has been closed. The control unit 65 then determines that the pressure in the suction duct 60 has reached the predetermined negative pressure, and that the uppermost sheet Sb (see FIG. 3) has been suctioned to the suction conveyance belts 21. Then, the control unit 65 starts the drive motor 52 to rotate the suction conveyance belts 21 in the feeding direction.

Next, a sheet feeding operation of the sheet feeding apparatus 103 is described below. Basic operations thereof are similar to those described with reference to FIGS. 6 to 9.

As described above, when a feed signal is input to the sheet feeding apparatus 103 to feed a sheet, the air blowing unit 30 blows air against an end surface of the sheet stack SA. Several sheets Sa of the sheet stack SA are then floated by air. On the other hand, the suction fan 36 operates to blow air in the direction of an arrow F shown in FIG. 2. At that time, a suction shutter 37 provided in the suction duct 60 is closed. Consequently, a negative pressure is generated in a space provided on the side of the suction fan 36 from the suction shutter 37 of the suction duct 60.

Figure 3:
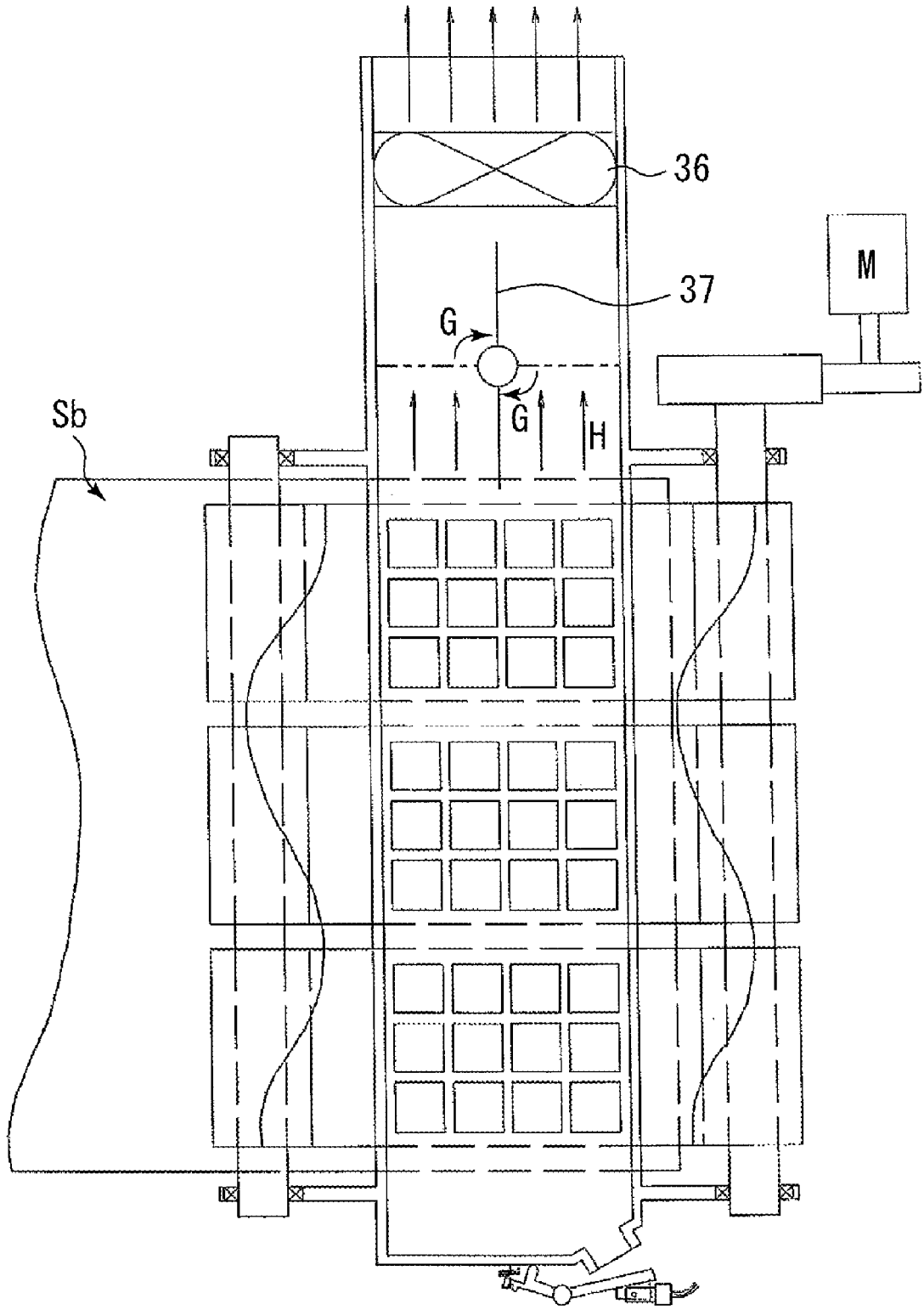
FIG. 3 is a diagram illustrating a sheet feeding operation of the sheet feeding apparatus.

Next, when a floating condition of the several sheets Sa is stabilized after the lapse of a predetermined time since the feed signal is input to the sheet feeding apparatus 103, the suction shutter 37 is rotated in the direction of an arrow G, as shown in FIG. 3. Consequently, a suctioning force from the suction fan 36 is applied to the sheets through the suction holes 21*a* formed in the suction conveyance belts 21 and the plurality of suction openings 60A formed in the suction duct 60. Thus, the uppermost sheet Sb is suctioned to the suction conveyance belts 21.

Figure 4:
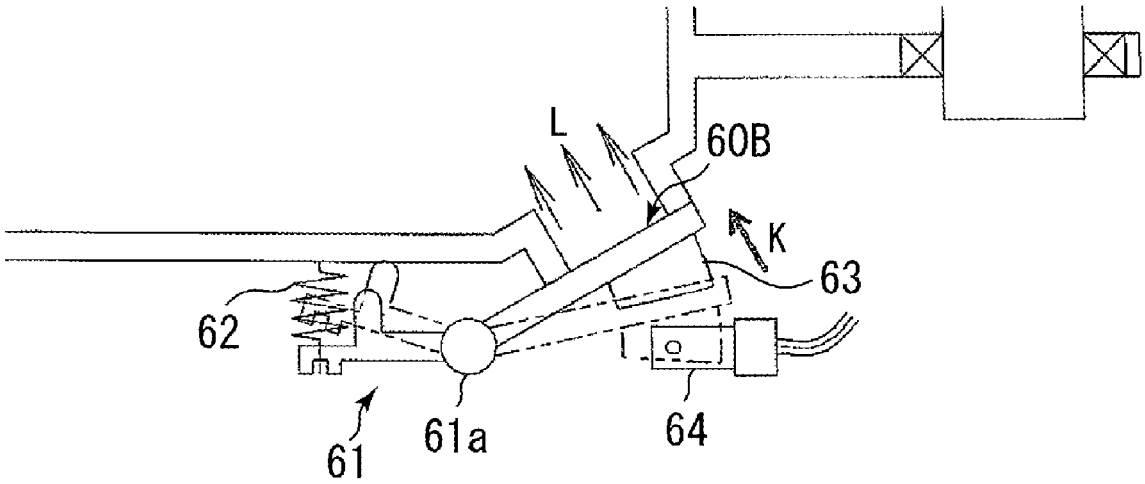
FIG. 4 is a diagram illustrating an operation of an opening/closing detection unit provided in the sheet feeding apparatus.
Figure 5:
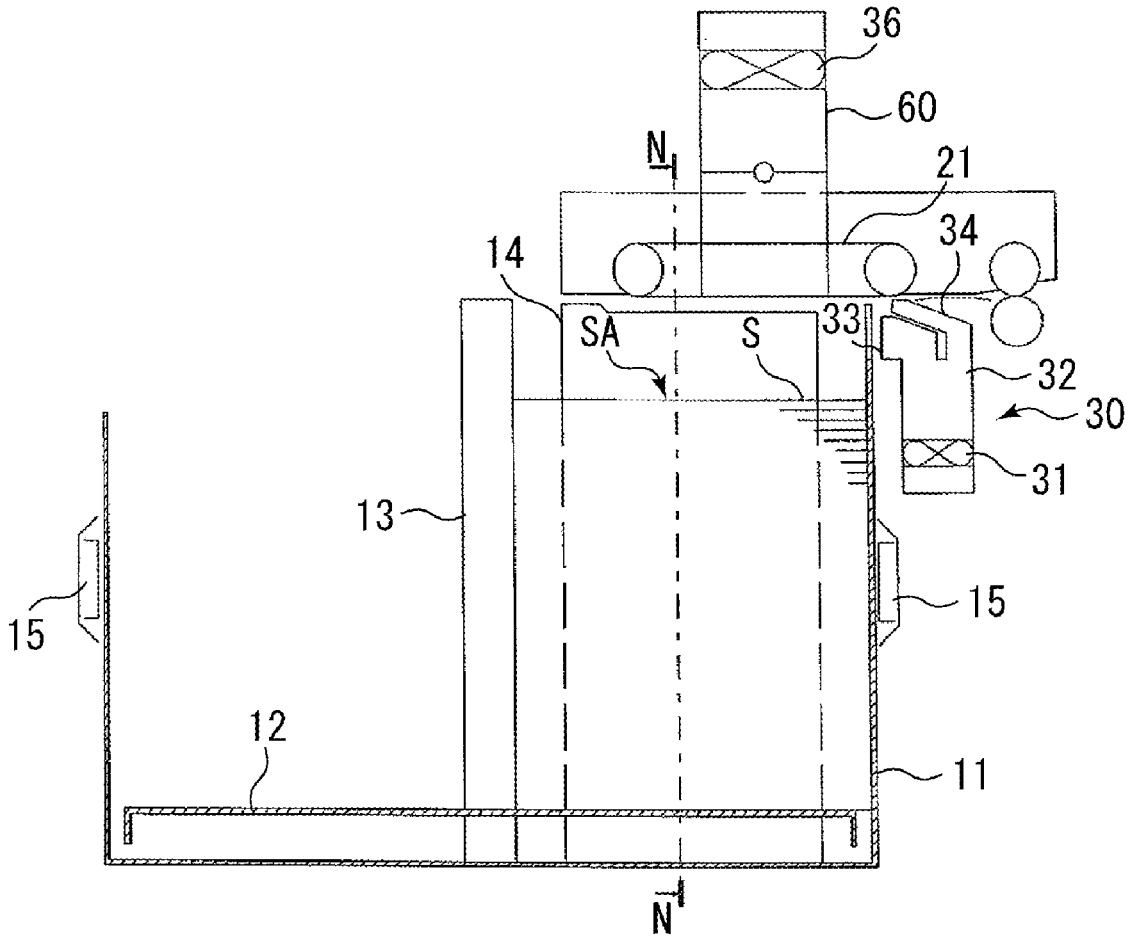
FIG. 5 (PRIOR ART)
FIG. 5 is a diagram schematically illustrating a conventional sheet feeding apparatus.
Figure 6:
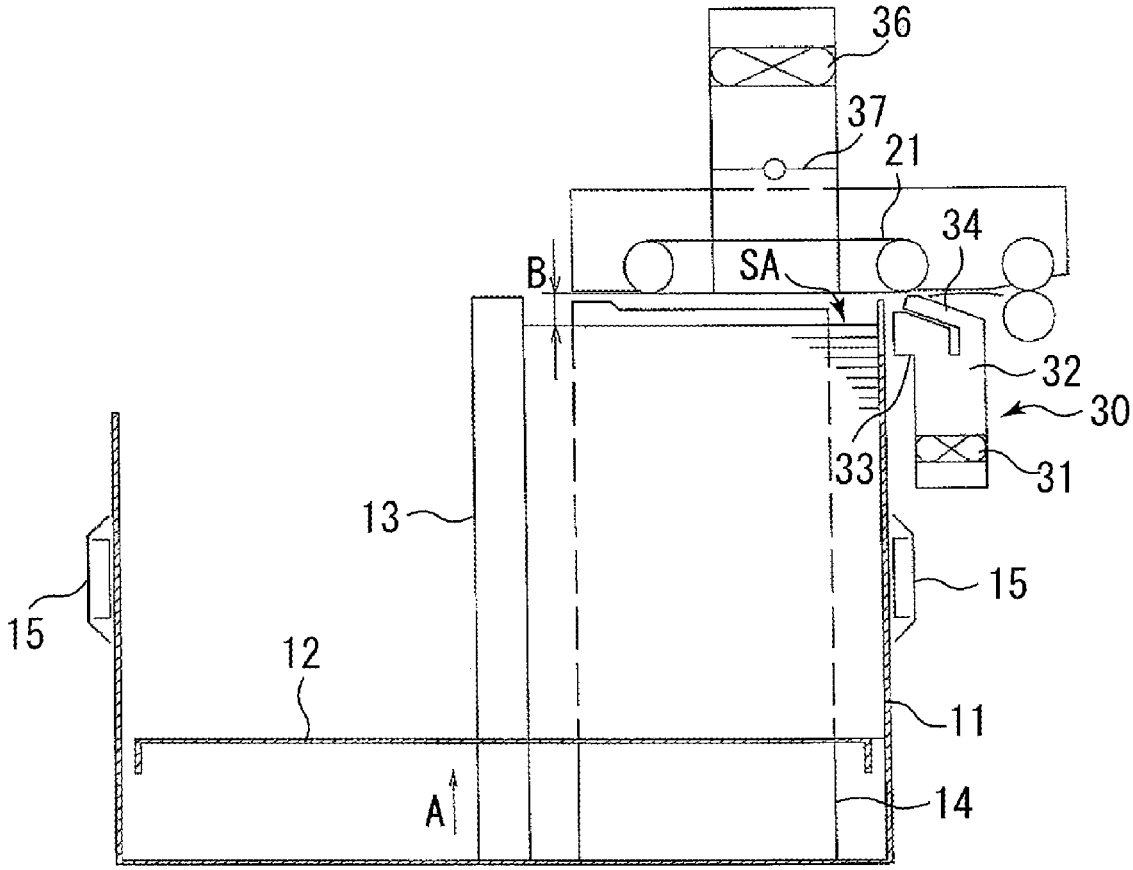
FIG. 6 (PRIOR ART)
FIG. 6 illustrates a sheet feeding operation of the conventional sheet feeding apparatus.
Figure 7:
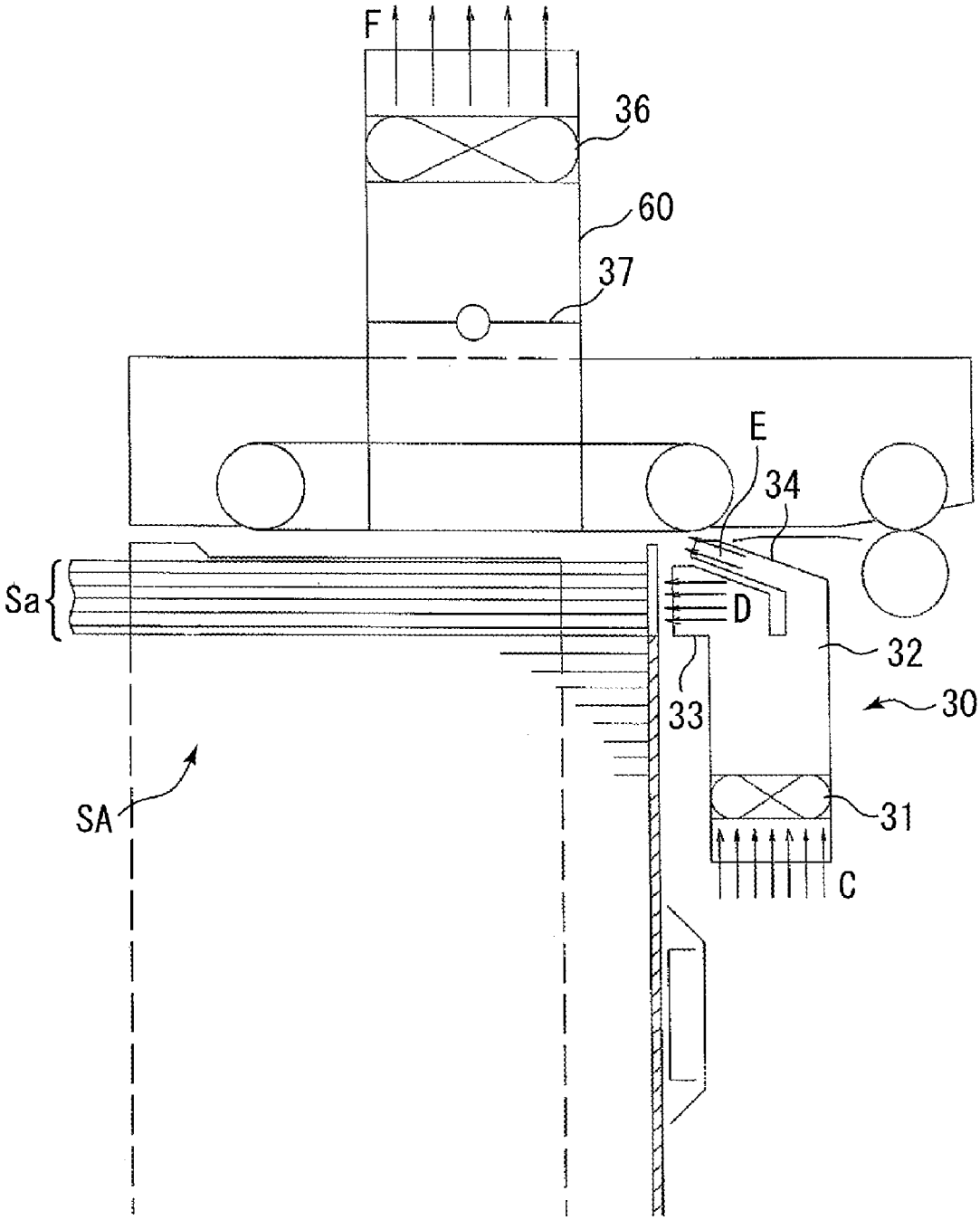
FIG. 7 (PRIOR ART)
FIG. 7 illustrates a sheet feeding operation of the conventional sheet feeding apparatus.
Figure 8:
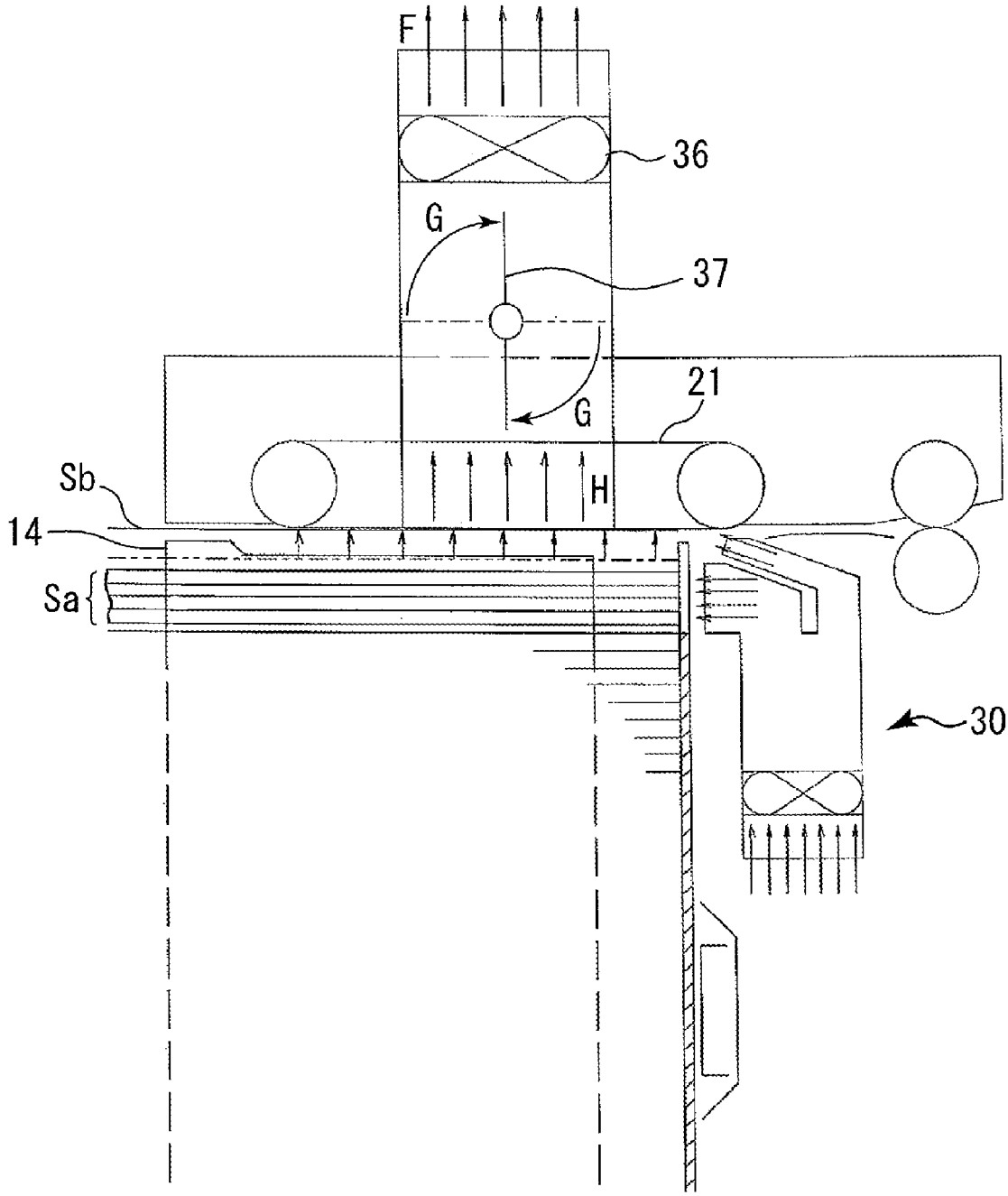
FIG. 8 (PRIOR ART)
FIG. 8 illustrates a sheet feeding operation of the conventional sheet feeding apparatus.
Figure 9:
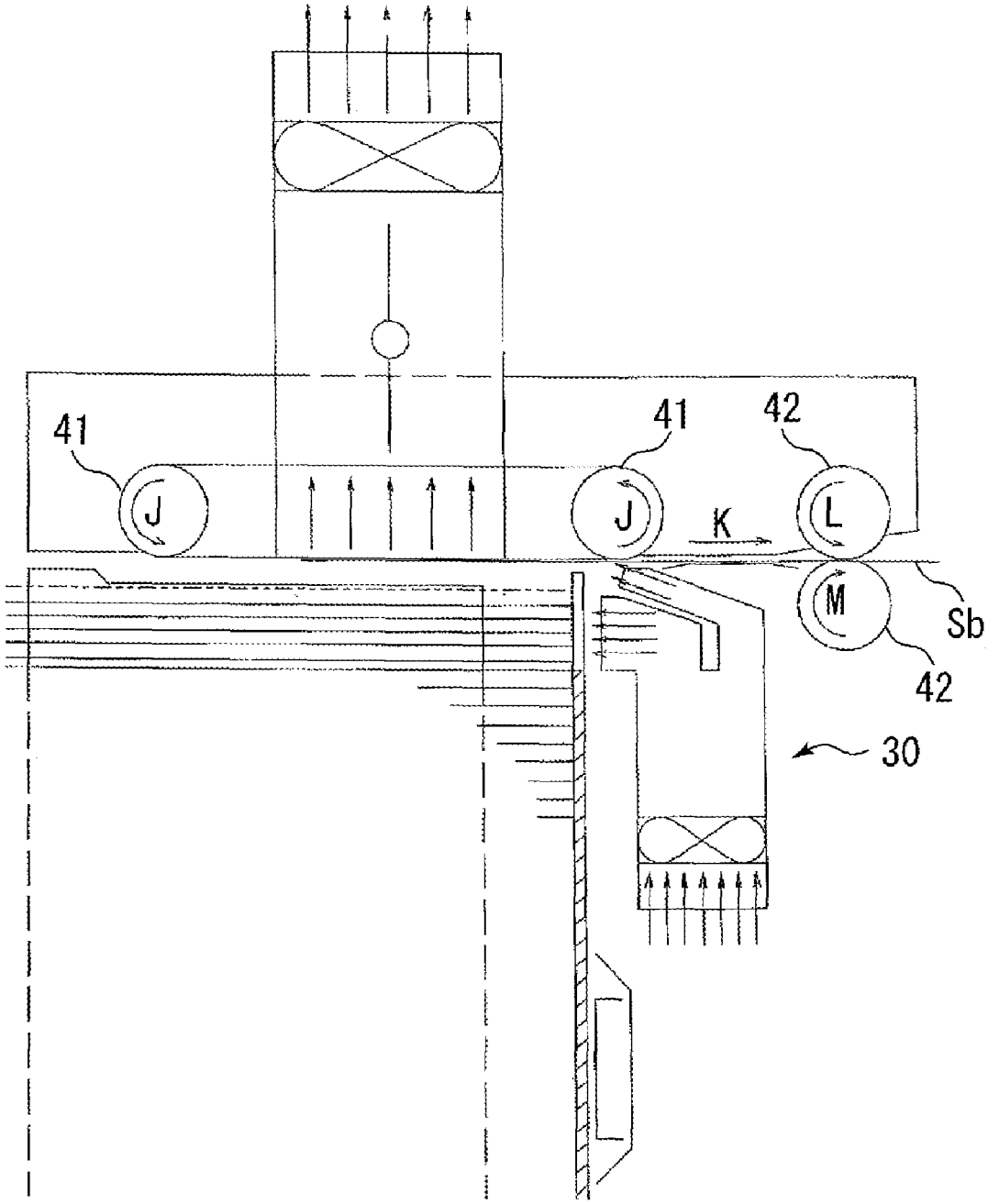
FIG. 9 (PRIOR ART)
FIG. 9 illustrates a sheet feeding operation of the conventional sheet feeding apparatus.

When the uppermost sheet Sb is suctioned to the suction conveyance belts 21, the suction openings 60A are closed by the uppermost sheet Sb. Thus, a negative pressure in the suction duct 60 gradually increases. When a magnitude of the negative pressure in the suction duct 60 reaches a predetermined value, a large suctioning force acting in the direction of an arrow L is generated in the suction detecting hole 60B of the suction duct 60 shown in FIG. 4, because the suction holes 21*a* formed in the suction conveyance belts 21 and the suction openings 60A of the suction duct 60 are closed by the sheet.

Then, such a large suctioning force cause the suction detecting cover 61 to swing in the direction of an arrow K against an elastic force of the return spring 62 and to move to a position to close the suction detecting hole 60B. Consequently, the level of an output signal from the photo-interrupter 64 changes from the OFF-level to the ON-level. Accordingly, the control unit 65 determines, according to a change in the level of the output signal from the photo-interrupter 64, that the suction detecting cover 61 has closed the suction detecting hole 60B.

Thus, when the level of the output signal from the photo-interrupter 64 changes from the OFF-level to the ON-level, the control unit 65 can determine that the uppermost sheet Sb has been completely suctioned to the suction conveyance belts 21. Subsequently, the control unit 65 starts driving the suction conveyance belts 21.

Thus, the sheet feeding apparatus 103 starts feeding the uppermost sheet Sb while the sheet Sb is completely suctioned to the suction conveyance belts 21. Consequently, problems, such as a jam, a skew, a positional deviation, flaws, folds, and stains, can be prevented or reduced.

As described above, the suction conveyance belts 21 are driven after the suction detecting hole 60B is closed according to the magnitude of the negative pressure in the suction duct 60, which increases as the sheet is suctioned to the suction conveyance belts 21. Thus, sheets can surely be separated and fed. Consequently, sheets can surely be separated and fed without being affected by the environment. As a result, reliability can be enhanced. Additionally, a downtime of the apparatus can be reduced as much as possible.

Additionally, the completion of suctioning a sheet can be detected according to the ON-level or the OFF-level of the output signal from the photo-interrupter 64. Thus, a control operation can be simplified. Also, the suction detecting hole 60B is opened and closed by the suction detecting cover 61, which is swingably provided in the sheet feeding apparatus 103, with the return spring 62. Thus, components are very simply shaped. The number of components is small. The configuration of the sheet feeding apparatus 103 can be simplified at low cost.

In the foregoing description, the sheet feeding apparatus 103 is configured to drive the suction conveyance belts 21 while fixing the suction duct 60. However, the sheet feeding apparatus 103 may be configured so that a suction duct itself repeatedly reciprocates to transfer a sheet to a drawing roller pair, without using a suction conveyance belt.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-013075 filed Jan. 20, 2006, which is hereby incorporated by reference herein in its entirety.

What is claimed is:

1. A sheet feeding apparatus configured to blow air against an end surface of sheets stacked on a sheet stacking unit so as to float the sheet and to suction and feed the floated sheet, the sheet feeding apparatus comprising:

a suction duct disposed above the sheet stacking unit;

a negative pressure generating unit configured to generate a negative pressure in the suction duct;

a sheet conveyance unit configured to suction a sheet thereto by utilizing the negative pressure generated by the negative pressure generating unit and to convey the suctioned sheet;

a communicating opening provided in the suction duct and adapted to communicate with an exterior;

a cover configured to open and close the communicating opening according to a magnitude of the negative pressure in the suction duct;

a detecting unit configured to detect that the cover has closed the communicating opening; and a control unit configured to start an operation of the sheet conveyance unit based on the detecting unit detecting that the cover has closed the communicating opening.

2. The sheet feeding apparatus according to claim 1, wherein the sheet conveyance unit includes a conveyance belt having a plurality of suction holes and configured to rotate with an inner circumferential surface thereof abutting on a suction opening of the suction duct facing the sheet stacking unit.

3. The sheet feeding apparatus according to claim 1, wherein the cover is configured to be swingable, wherein the cover is biased by an elastic member in a direction to open the communicating opening, and wherein the cover is configured to close the communicating opening against a biasing force of the elastic member according to the magnitude of the negative pressure in the suction duct.

4. An image forming apparatus comprising:

the sheet feeding apparatus according to claim 1; and an image forming unit configured to form an image on a sheet fed from the sheet feeding apparatus.

* * * * *